US009216573B2

(12) United States Patent
Kim et al.

(10) Patent No.: US 9,216,573 B2
(45) Date of Patent: Dec. 22, 2015

(54) APPARATUS FOR CONTROLLING DROPLET MOTION IN ELECTRIC FIELD AND METHOD OF THE SAME

(75) Inventors: Bum-Joo Kim, Pohang-si (KR); Intae Kim, Pohang-si (KR); Geunbae Lim, Pohang-si (KR)

(73) Assignee: POSTECH ACADEMY-INDUSTRY FOUNDATION, Pohang (KR)

( * ) Notice: Subject to any disclaimer, the term of this patent is extended or adjusted under 35 U.S.C. 154(b) by 871 days.

(21) Appl. No.: 12/947,863

(22) Filed: Nov. 17, 2010

(65) Prior Publication Data

US 2011/0114192 A1 May 19, 2011

(30) Foreign Application Priority Data

Nov. 17, 2009 (KR) ..... 10-2009-0111109

(51) Int. Cl.
*B05B 5/00* (2006.01)
*B41J 2/095* (2006.01)

(52) U.S. Cl.
CPC ..... *B41J 2/095* (2013.01); *Y10T 137/0391* (2015.04); *Y10T 137/206* (2015.04)

(58) Field of Classification Search
CPC ..... B05B 5/0255; B05B 5/03; B05B 5/032; B05B 5/0533; B05B 5/0535; B41J 2/095; Y10T 137/206; Y10T 137/0391
USPC ..... 239/3, 690, 697, 690.1, 760; 137/13, 137/803; 347/55, 74
See application file for complete search history.

(56) References Cited

U.S. PATENT DOCUMENTS

| | | | | | |
|---|---|---|---|---|---|
| 4,726,521 | A * | 2/1988 | Simm | B05B 5/043 | 239/122 |
| 6,105,571 | A * | 8/2000 | Coffee | A61M 15/0091 | 128/200.14 |
| 6,520,402 | B2 * | 2/2003 | Orme-Marmerelis | B22F 1/0048 | 228/260 |
| 7,977,527 | B2 * | 7/2011 | Coffee | A61F 13/00063 | 239/3 |
| 2004/0182948 | A1 * | 9/2004 | Yogi | B01F 5/0085 | 239/3 |
| 2006/0262163 | A1 * | 11/2006 | Nishio | B05B 5/0255 | 347/55 |
| 2010/0155496 | A1 * | 6/2010 | Stark | B05B 5/0255 | 239/3 |

FOREIGN PATENT DOCUMENTS

| | | | | |
|---|---|---|---|---|
| GB | WO2008/142393 A1 * | 11/2008 | | B05B 5/025 |
| JP | 02-002058 | 1/1990 | | |
| JP | 2005-074634 | 3/2005 | | |
| KR | 10-0146540 | 5/1998 | | |
| KR | 10-2005-0054962 | 6/2005 | | |
| WO | PCT/US01/08677 * | 9/2001 | | G01N 1/00 |

* cited by examiner

*Primary Examiner* — Len Tran
*Assistant Examiner* — Joel Zhou
(74) *Attorney, Agent, or Firm* — Lex IP Meister, PLLC

(57) ABSTRACT

The present invention relates to an apparatus for controlling droplet motion in an electric field by reducing volume of a single droplet to a very small volume using a strong electric field and controlling a position of a droplet using a repulsive force of the same polarity, and a method of the same. The apparatus according to an exemplary embodiment of the present invention includes a first electrode, an insulator disposed above the first electrode, a discharge tip disposed above the insulator by a predetermined distance and dividing a transferred fluid into a small volume of a droplet, and a second electrode contacting the fluid supplied through the discharge tip. The first electrode and the second electrode may form an electric field at an end of the discharge tip by forming a potential difference between the first electrode and the second electrode.

3 Claims, 17 Drawing Sheets

APPARATUS FOR CONTROLLING DROPLET MOTION IN ELECTRIC FIELD AND METHOD OF THE SAME

CROSS-REFERENCE TO RELATED APPLICATION

This application claims priority to and the benefit of Korean Patent Application No. 10-2009-0111109 filed in the Korean Intellectual Property Office on Nov. 17, 2009, the entire contents of which are incorporated herein by reference.

BACKGROUND OF THE INVENTION (a) Field of the Invention

The present invention relates to an apparatus for controlling droplet motion in an electric field and a method thereof. More particularly, the present invention relates to an apparatus for controlling droplet motion in an electric field by reducing the volume of a single droplet to a very small volume using a strong electric field and controlling the position of a droplet using a repulsive force of the same polarity, and a method of the same.

(b) Description of the Related Art

An apparatus for discharging a very small droplet has been introduced. The apparatus for discharging droplets may employ a syringe pump, a solenoid valve, an inkjet nozzle made of a piezolelectric material, or a thermal-type inkjet nozzle.

There has been a demand to reduce droplet volume to a minute volume and to control the position of a discharged droplet in the droplet discharge apparatus.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an apparatus for controlling droplet motion in an electric field having advantages of reducing droplet volume to a minute volume and controlling the position of a discharged droplet using a repulsive force of the same polarity.

According to an exemplary embodiment of the present invention, an apparatus for controlling droplet motion in an electric field includes a first electrode, an insulator disposed above the first electrode, a discharge tip disposed above the insulator by a predetermined distance and dividing a transferred fluid into a small volume of a droplet, and a second electrode contacting the fluid supplied through the discharge tip. The first electrode and the second electrode may form an electric field at an end of the discharge tip by forming a potential difference between the first electrode and the second electrode.

The first electrode may be supplied with a high voltage or is grounded, and the second electrode may be grounded or supplied with a high voltage on the contrary to the first electrode.

The first electrode and the second electrode may be supplied with a positive or negative charge when the high voltage is supplied to the first and second electrodes.

The first electrode may be supplied with a high voltage, and the second electrode may be disposed at a tube connected to the discharge tip and that grounds the fluid.

The first electrode may be grounded, and the second electrode may be disposed at a tube connected to the discharge tip and that supplies a high voltage to the fluid.

According to the exemplary embodiment of the present invention, the apparatus may further include a charge exposing member connected to the first electrode. The charge exposing member may expose the positive charge or the negative charge of the high voltage between the first electrode and the discharge tip.

The charge exposing member may include an exposing unit exposing one of the positive charge and the negative charge.

The discharge tip may include a plurality of discharge tips disposed above the first electrode.

Each one of the plurality of discharge tips may have a different size of discharging opening.

The tube may include a plurality of tubes divided from an integral tube part and respectively connected to the plurality of discharge tips, and the second electrode may be disposed at the integral tube part.

The tube may be divided into a plurality of tubes and the plurality of tubes may be respectively connected to the plurality of discharge tips, a plurality of the second electrodes may be respectively disposed at the plurality of tubes, and the plurality of second electrodes may be independently on/off controlled by a plurality of switches respectively connected to the plurality of second electrodes.

According to another exemplary embodiment of the present invention, there is provided an apparatus for controlling droplet motion in an electric field, including an electrode, an insulator disposed above the electrode, and a discharge tip disposed above the insulator by a predetermined distance and dividing a transferred fluid into small volume of droplets. The electrode and the discharge tip may form an electric field at an end of the discharge tip by forming a potential difference between the electrode and the discharge tip.

The electrode may be supplied with a high voltage or is grounded, and the discharge tip may be grounded or supplied with the high voltage on the contrary to the electrode.

The electrode and the discharge tip may be supplied with a positive charge or a negative charge of a high voltage when the high voltage is supplied.

The fluid may be grounded by supplying a high voltage to the electrode and grounding the discharge tip.

A high voltage may be supplied to the fluid by grounding the electrode and supplying a high voltage to the discharge tip.

According to still another exemplary embodiment of the present invention, there is provided an apparatus for controlling droplet motion including an insulator, a discharge tip disposed above the insulator by a predetermined distance and dividing a transferred fluid into a small volume of droplets, a first electrode having a shape of a ring, disposed between the insulator and the discharge tip, and passing the droplets, and a second electrode contacting a fluid supplied through the discharge tip. The first electrode and the second electrode may form an electric field at an end of the discharge tip by forming a potential difference between the first electrode and the second electrode.

The first electrode may be supplied with a high voltage or is grounded, and the second electrode may be grounded or supplied with a high voltage on the contrary to the first electrode.

The first electrode and the second electrode may be supplied with a positive charge or a negative charge of a high voltage when the high voltage is supplied.

The first electrode may be supplied with a high voltage, and the second electrode may be disposed at a tube connected to the discharge tip and that grounds the fluid.

The first electrode may be grounded, and the second electrode may be disposed at a tube connected to the discharge tip and that supplies a high voltage to the fluid.

According to yet another exemplary embodiment of the present invention, a method of controlling droplet motion in an electric field is provided. In the method, a first electrode and a discharge tip are disposed to face each other in a vertical direction. An insulator is disposed on the first electrode, and a second electrode contacts a transferred fluid by disposing the second electrode at a tube transferring the fluid to the discharge tip. An electric field is formed at an end of the discharge tip by forming a potential difference between the first electrode and the second electrode by supplying a high voltage to the first electrode and grounding the second electrode or supplying a high voltage to the second electrode and grounding the first electrode. A first droplet having a polarity opposite to that of the first electrode is formed with droplets discharged from the discharge tip and gathered on the insulator. Then, a position of a second droplet is controlled by repelling the second droplet around the first droplet, wherein the second droplet is discharged toward the first droplet from the discharge tip and has a polarity identical to that of the first droplet.

In the forming of an electric field, the first electrode may be supplied with a positive charge of a high voltage, and the second electrode is grounded.

In the forming of a first droplet, the first droplet may be charged with a negative charge, and in the controlling a position of a second droplet, the second droplet may be charged with a negative charge.

In the forming of an electric field, the first electrode may be supplied with a negative charge of a high voltage, and the second electrode is grounded.

In the forming of a first droplet, the first droplet may be charged with a positive charge, and in the controlling a position of a second droplet, the second droplet may be charged with a positive charge.

In the forming of an electric field, the second electrode may be supplied with a positive charge of a high voltage and the first electrode is grounded.

In the forming of a first droplet, the first droplet may be charged with a positive charge, and in the controlling a position of a second droplet, the second droplet may be charged with a positive charge.

In the forming of an electric field, the second electrode may be supplied with a negative charge of a high voltage, and the first electrode may be grounded.

In the forming of a first droplet, the first droplet may be charged with a negative charge, and in the controlling a position of a second droplet, the second droplet may be charged with a negative charge.

The first droplet and the second droplet may be formed with the same volume or a different volume.

The forming of an electric field may further include controlling electric field strength by controlling a voltage supplied between the first electrode and the second electrode.

The disposing a first electrode and a discharge tip may further include setting up an area of the insulator.

The disposing a first electrode and a discharge tip may further include setting up a thickness of the insulator.

The disposing a first electrode and discharge tip may further include controlling a position of an exposed part of the first electrode for a falling direction of the second droplet by controlling a position of the insulator.

The controlling a position of a second droplet may further include controlling a falling position of the second droplet by controlling a position of an exposing unit of a charge exposing member connected to the first electrode.

The forming of a first droplet may further include controlling a volume and a shape of the first droplet.

The controlling a position of a second droplet may further include controlling a position or a direction of the first droplet.

According to an exemplary embodiment of the present invention, a strong electric field is formed at an end of the discharge tip by forming a large potential difference by supplying a high voltage to one of the first electrode and the second electrode contacting a transferred fluid and grounding the other. Therefore, a volume of a single droplet is controlled to a minute volume.

According to an exemplary embodiment of the present invention, the first droplet having the opposite polarity to the first electrode is formed on the insulator and the second droplet having the same polarity to the first droplet is discharged from the discharge tip. Accordingly, a position of the second droplet is controlled by repelling the second droplet around the first droplet.

DETAILED DESCRIPTION OF THE EMBODIMENTS

Figure 1:
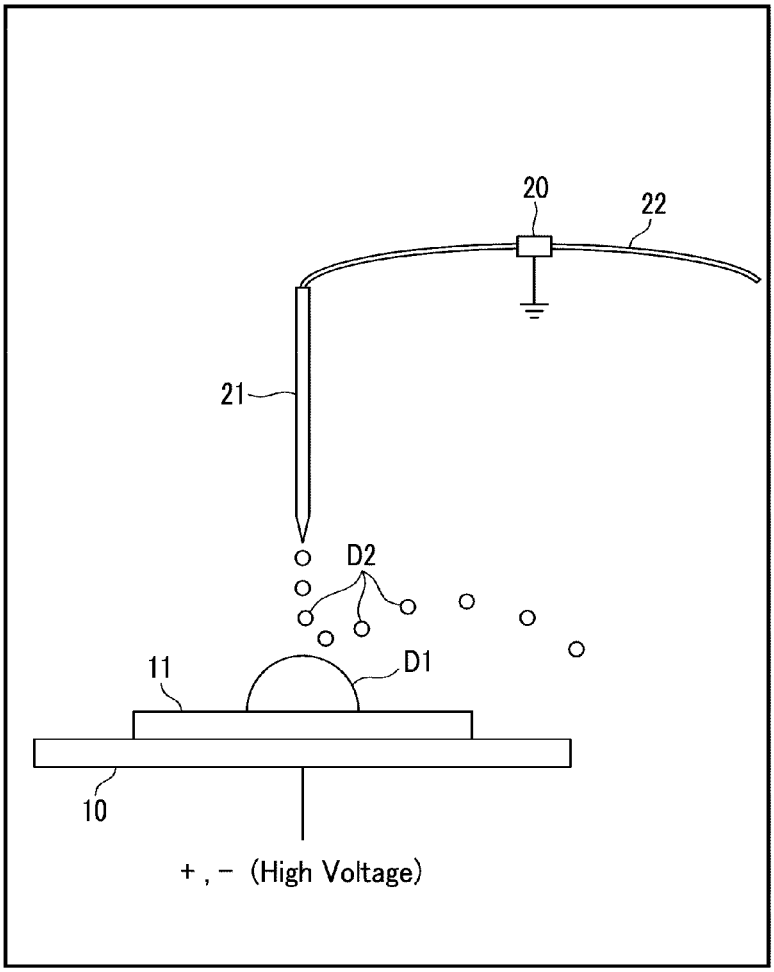
FIG. 1 is a schematic view of an apparatus for controlling droplet motion in an electric field according to the first exemplary embodiment of the present invention.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is a schematic view illustrating an apparatus for controlling droplet motion in an electric field in accordance with the first exemplary embodiment of the present invention. Referring to FIG. 1, the apparatus for controlling droplet motion in an electric field (hereinafter, "controlling apparatus") includes first and second electrodes 10 and 20, an insulator 11 disposed on the first electrode 10, and a discharge tip 21 disposed above a first droplet D1 formed at the insulator 11 and discharging a second droplet D2 toward the first droplet D1.

The first and second electrodes 10 and 20 may be supplied with a high voltage or are grounded, respectively. That is, when a high voltage is supplied to the first electrode 10, the second electrode 20 is grounded. On the contrary, when the first electrode 10 is grounded, the high voltage is supplied to the second electrode 20. Accordingly, a potential difference is formed between the first electrode 10 and the second electrode 20, that is, between the first electrode 10 and the discharge tip 21. As a result, a strong electric field is formed at an end of the discharge tip 21.

The first electrode 10 is disposed under the discharge tip 21. The second electrode 20 is disposed to directly contact a fluid such as water in order to supply a high voltage to the fluid or ground the fluid. When the high voltage is supplied, a positive charge voltage or a negative charge voltage may be supplied to the first electrode 10 and the second electrode 20.

For example, when a positive charge voltage or a negative charge voltage is supplied to the first electrode 10, the second electrode 20 may be grounded as 0 volts. When a positive charge voltage or a negative charge voltage is supplied to the second electrode 20, the first electrode 10 may be grounded as 0 volts.

Since the controlling apparatus according to the first exemplary embodiment induces the first and second droplets D1 and D2 to have the same polarity, the first and second droplets D1 and D2 push each other away by a repulsive force. Such a phenomenon is referred as droplet repulsion.

For example, the controlling apparatus according to the first embodiment supplies a positive high voltage or a negative high voltage to the first electrode 10, grounds the second electrode 20, and moves and disposes the discharge tip 21 between the first electrode 10 and the second electrode 20.

When the positive high voltage is supplied to the first electrode 10, the second droplet D2 and the first droplet D1 have the same negative polarity. When the negative high voltage is supplied to the first electrode 10, the second droplet D2 and the first droplet D1 have the same positive polarity.

The discharge tip 21 may be formed of an insulator or a conductor in order to discharge a minute volume of a droplet. An interior diameter of the discharge tip 21 is about 100 μm. The interior diameter, exterior diameter, discharging opening, flow velocity, and electric field strength of the discharge tip 21 limit the volume of a single droplet. For example, the discharge tip 21 may be connected to a pump such as a syringe pump (not shown) through a Teflon tube 22. Such a discharge tip 21 continuously receives a fluid through the Teflon tube 22 and discharges minute droplets.

For example, the insulator 11 may be made of Teflon or an acryl and disposed on the first electrode 10. The insulator 11 enables the second droplet D2 to have the same polarity as the first droplet D1 formed on the insulator 11. However, the insulator 11 according to the first embodiment is not limited thereto. The insulator 11 may be made of various materials having an electric insulating property.

Since the large first droplet D1 on the insulator 11 has the same polarity as the second droplet D2 falling toward the first droplet D1, the second droplet D2 is repelled around the first droplet D1. That is, droplet repulsion occurs. Hereinafter, the occurrence of droplet repulsion will be described in detail.

As an example, when a small volume of fluid of about 10 to 20 μl/min is supplied to the discharge tip 21 using the syringe pump (not shown) after supplying a positive high voltage of about 4 to 20 kV to the first electrode 10, the strong positive charge is formed around the first electrode 10. Accordingly, fluid molecules arranged in the discharge tip 21 are induced to have a negative charge, and negative charged fluid molecules are gathered at an end of the discharge tip 21. The more the fluid molecules are gathered at the end of the discharge tip 21, the stronger the static electricity is applied thereto. Here, the static electricity may be an attractive force with a positive charge source of the first electrode 10 and a repulsive force with a negative charge source of the fluid inside the discharge tip 21. As a result, a droplet is discharged in a vertical direction, and discharging speed is accelerated.

The droplets are discharged in the vertical direction very rapidly, regularly, and constantly. When the first droplet D1 is charged with a sufficient quantum of electricity, the first droplet D1 statically repels the second droplet D2 discharged from the discharge tip 21. Here, as the second droplet D2 increases in volume, the first droplet D1 may become identical to or smaller than the second droplet D2 in volume.

Figure 2:
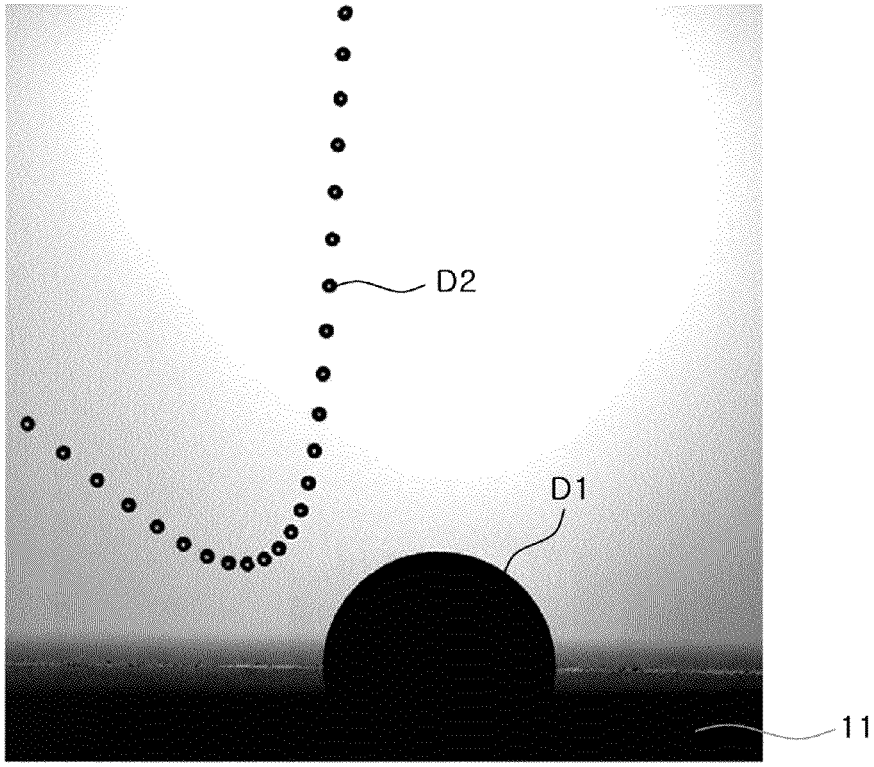
FIG. 2 is a picture capturing a droplet repulsion phenomenon occurring in the controlling apparatus of FIG. 1.

FIG. 2 is a picture capturing a droplet repulsion phenomenon occurring in the controlling apparatus of FIG. 1. FIG. 2 illustrate the droplet repulsion phenomenon captured using a high speed camera. For example, a positive high voltage is supplied to the first electrode 10. The second droplet D2 discharged from the end of the discharge tip 21 falls in a vertical direction and is repelled due to the static repulsive force formed between the second droplet D2 and the first droplet D1.

An interval of capturing the second droplets D1 is about 1/1200 sec. Instantaneous velocity of the second droplet D2 discharging from the end of the discharge tip 21 is about 0. Therefore, overall velocity distribution progresses in order of acceleration, deceleration, direction change due to droplet repulsion, and acceleration when the velocity distribution is observed based on distances between the second droplets D2 in traces of the second droplets D2.

In an initial acceleration period, the second droplet D2 is accelerated due to the attractive force of the positive charge source of the first electrode 10. As the distance to the first droplet D1 becomes close, the second droplet D2 is strongly influenced by a repulsive force between the first droplet D1 and the second droplet D2, which is stronger than the attractive force of the positive charge source. Accordingly, the second droplet D2 is decelerated.

The second droplet D2 continuously decelerates and the velocity thereof converges to almost 0 due to the repulsive force from the first droplet D1. Finally, the second droplet D2 changes its direction to avoid the first droplet D1.

After changing the direction, the second droplet D2 accelerates due to the repulsive force from the first droplet D1. Since the repulsive force becomes weak, the second droplet D2 flies in an arc and finally arrives at a location about several cm away from the first droplet D1.

Meanwhile, the droplet repulsion phenomenon provides different experimental results according to variables. That is, the droplet repulsion phenomenon has a constant tendency according to predetermined conditions.

Experimental variables of a performed droplet repulsion experiment includes electric field strength between the first electrode 10 and the discharge tip 21, and area and thickness of the insulator 11, the type of fluid supplied to the discharge tip 21, and the stability of the controlling apparatus.

First, the electric field strength will be described. The stronger the electric field strength becomes, the easily the droplet repulsion phenomenon occurs. The increment of the electric field strength may be the same as the increment of the electric static force and the decrement of the second droplet D2 in volume.

The second droplets D2 discharged from the discharge tip 21 is repelled differently because discharging speed and repulsive force with the first droplet D1 are changed according to the electric static force varied by an external electric field.

That is, when the electric field strength becomes weak, the volume of the second droplet D2 becomes smaller. Further, a stronger negative charge is induced to the fluid inside the discharge tip 21 as the external electric field strength becomes stronger. The fluid tends to form further smaller second droplets D2 due to the abrupt increment of electric charge.

As described in terms of the theory of Rayleigh instability, the volume of the droplet becomes smaller for stability.

Figure 3:
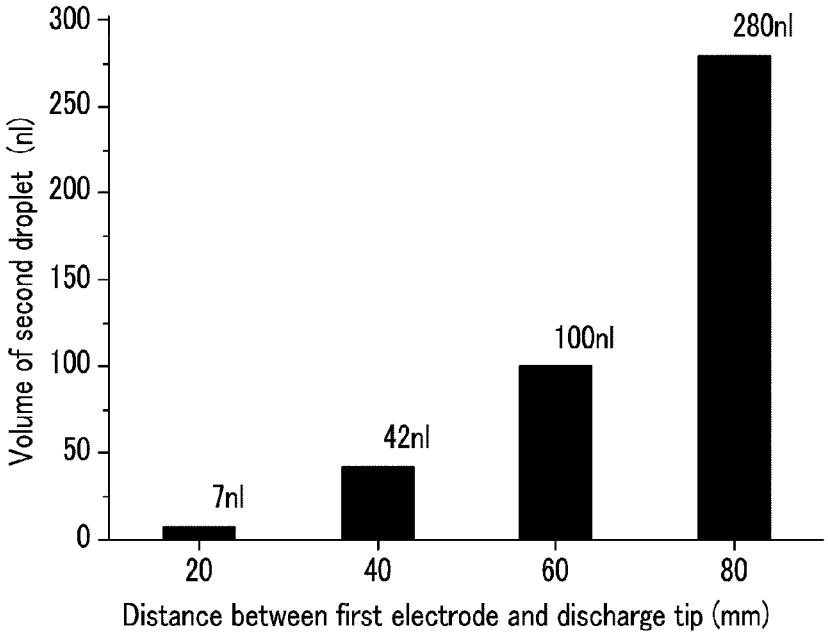
FIG. 3 is a graph comparing a volume of a second droplet according to electric field strength in the controlling apparatus of FIG. 1.

FIG. 3 is a graph comparing volumes of second droplets according to electric field strength in the controlling apparatus of FIG. 1. Referring to FIG. 3, the first electrode 10 is supplied with a positive voltage of about 20 kV and the second electrode 20 is grounded. The volume of the second droplet D2 is measured while changing the distance between the first electrode 10 and the discharge tip 21 from about 20 mm to about 80 mm.

Since a constant voltage is supplied to the first electrode 10 and the fluid of the discharge tip 21, the electric field strength is reduced as the first electrode 10 becomes far away from the discharge tip 21. As shown in the graph, the volume of the second droplet D2 is abruptly reduced as the electric field strength becomes stronger (i.e., becomes a shorter distance).

The mass of the second droplet D2 becomes lighter when the volume of the second droplet D2 becomes smaller. Accordingly, the second droplet D2 is easily repelled around the first droplet D1.

Hereinafter, the area and the thickness of the insulator 11 will be described. The area and the thickness of the insulator 11 influence the droplet repulsion phenomenon, and the droplet repulsion phenomenon has a constant tendency according to the area and the thickness of the insulator 11.

Figure 4:
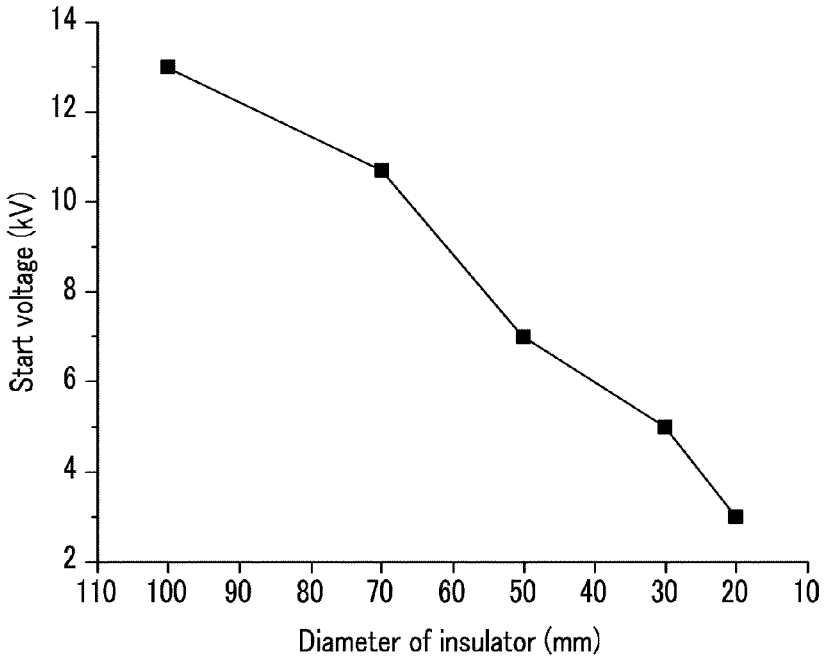
FIG. 4 is a graph showing a start voltage according to an area of an insulator in the controlling apparatus of FIG. 1.

FIG. 4 is a graph showing start voltage according to area of an insulator in a controlling apparatus of FIG. 1. Referring to FIG. 4, the first electrode 10 is supplied with a positive high voltage, and the start voltage is measured while changing an area of the insulator 11. Here, the area is shown as a diameter of the insulator.

The start voltage denotes a voltage at a point where a droplet repulsion phenomenon starts occurring while a voltage supplied to the first electrode 10 and the second electrode 20 gradually increases from about 0V.

A low start voltage means that a droplet repulsion phenomenon starts occurring at a low voltage. Accordingly, the low start voltage means an environmental condition that easily invokes the droplet repulsion phenomenon. As shown in FIG. 4, the graph shows that the start voltage becomes higher as the area of the insulator 11 becomes larger.

That is, the droplet repulsion does not occur easily as the area of the insulator 11 becomes smaller. Here, the area of the insulator 11 may be an area of a positive charge source of the first electrode 10, which is exposed to the first droplet D1 under the second droplet D2.

Figure 5:
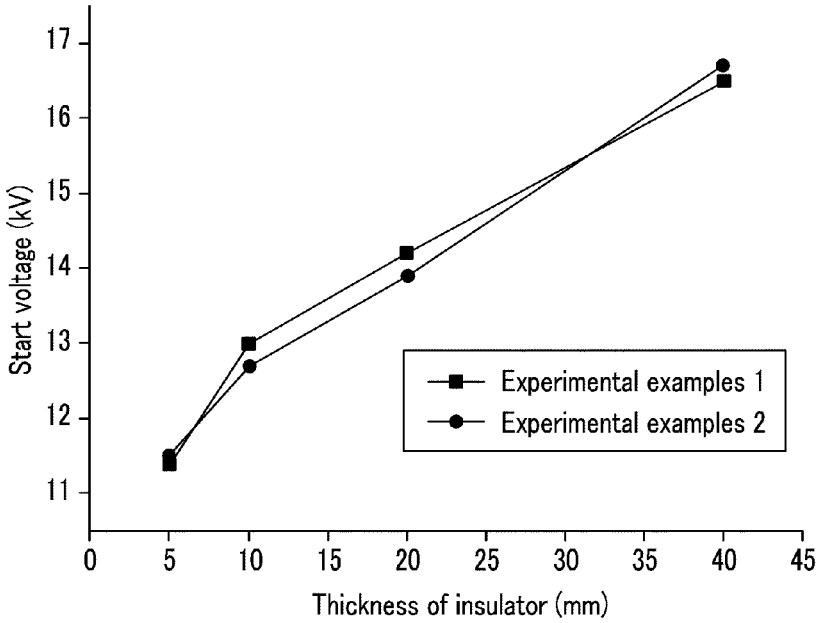
FIG. 5 is a graph showing a start voltage according to a thickness of an insulator in the controlling apparatus of FIG. 1.

Further, the graph shows that the droplet repulsion easily occurs as the exposed area (area of the insulator 11) of the positive charge source of the first electrode 10 becomes larger although the electric field strength is constant, FIG. 5 is a graph showing a start voltage according to a thickness of an insulator in a controlling apparatus of FIG. 1. As an example, a positive high voltage is supplied to the first electrode 10. The graph shows that the start voltage is influenced by the thickness of the insulator 11 as well as the area thereof. As shown, similar results are obtained from two Experimental Examples 1 and 2.

FIG. 5 shows a tendency of a start voltage according to the thickness of the insulator 11. Referring to FIG. 5, the start voltage increases as the thickness of the insulator 11 becomes thicker. That is, the thicker the insulator 11 becomes, the easily the droplet repulsion occurs.

The graph shows that the thickness of the insulator 11 may influence the first droplet D1 formed on the insulator 11 more than the second droplet D2 discharged from the discharge tip 21. That is, the thickness of the insulator 11 significantly influences a quantity of electric charge induced to the first droplet D1. The thicker the insulator 11 becomes, the farther the first droplet D is away from the positive charge source of the first electrode 10. Accordingly, the quantity of electric charge induced to the first droplet D1 is also reduced.

Hereinafter, a fluid type of the second droplet D2 will be described. In an experiment, pure water is used as a fluid. It is considered that a result of droplet repulsion is caused by the polarity variation of fluid in an electric field.

The dielectric constant is significantly related to the rate of polarity variation of a fluid. The dielectric constant of pure water is about 80. In comparison with other fluid types, the dielectric constant of pure water is comparatively high. Accordingly, a non-polar material is used for the experiment. For example, benzene is used as the non-polar material. The dielectric constant thereof is 0. As expected, benzene does not invoke droplet repulsion.

However, the droplet repulsion is not related only to the dielectric constant of fluid. Although the experiment was performed with various materials having different dielectric constants, a tendency proportional only to the dielectric constant was not obtained. For convenience, the description of the experiment is omitted.

In addition to the dielectric constant, representative factors influencing the droplet repulsion may include surface tension and density of fluid. The smaller the surface tension is, the smaller the second droplet D2 formed at an end of the discharge tip 21 becomes. Accordingly, the droplet repulsion easily occurs.

In the same manner, the smaller the density is, the greater the surface charge becomes. Accordingly, the droplet repulsion occurs easily.

Since the dielectric constant, the surface intension, and the density are different according to the fluid type, it is considered that the droplet repulsion may be controlled according to the fluid type.

Hereinafter, a method of controlling the motion of the second droplet D2 in an electric field will be described. Before describing the method, the stability of a controlling apparatus will be described. In order to secure stability for an experimental result, because the droplet repulsion phenomenon is sensitive to peripheral disturbances or the experimental environment, these must be controlled.

For example, it was confirmed that the experimental result is influenced by air flow, a light source, or a low frequency signal generated from experimental equipment. When a very high voltage, for example higher than 20 kV, is supplied, the second droplet D2 becomes too small due to Rayleigh instability. Accordingly, the controlling apparatus becomes instable.

Hereinafter, a method of controlling the motion of the second droplet D2 in an electric field will be described. First, a method for controlling the position of the second droplet D2 using a positive charge source will be described.

Figure 6:
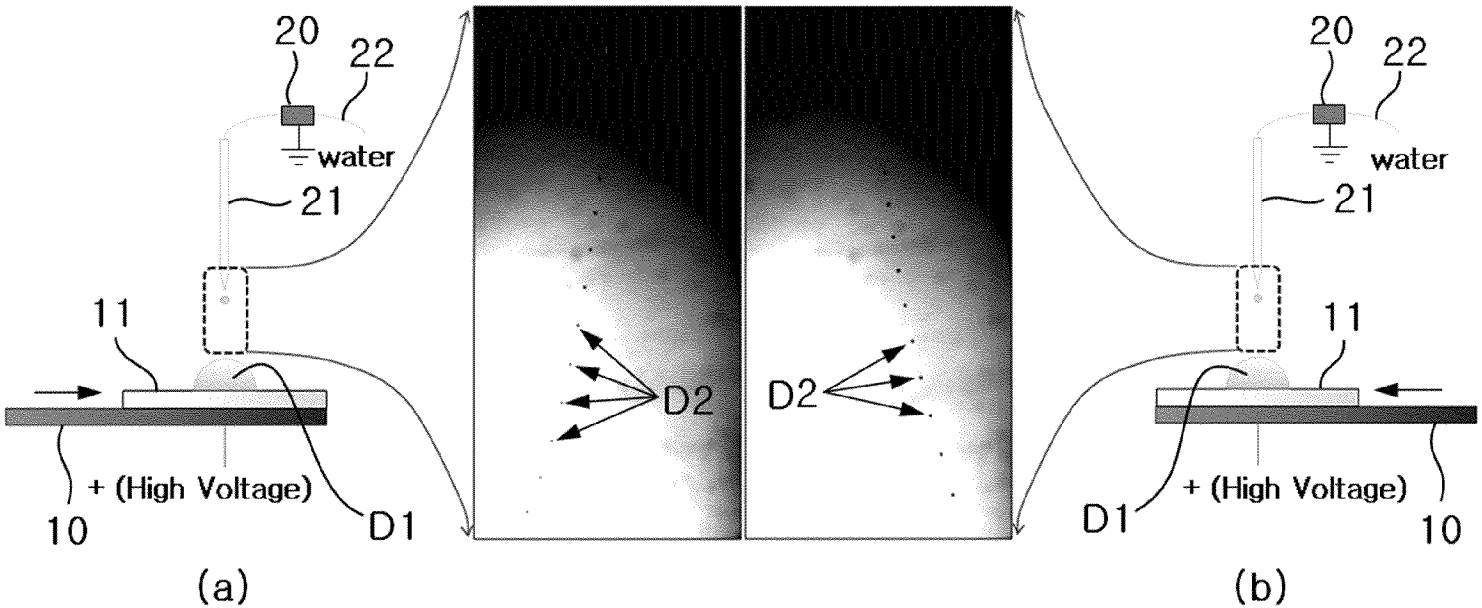
FIG. 6 is a picture illustrating a direction of second droplet motion according to an exposed position of a positive charge source in the controlling apparatus of FIG. 1.

FIG. 6 is a picture for comparing motion directions of second droplets according to location of an exposed part of a positive charge source in a controlling apparatus of FIG. 1. Referring to FIG. 6, the second droplet D2 discharged from the discharge tip 21 has a negative charge when a positive charge is supplied to the first electrode 10 and the second electrode 20 is grounded.

As shown in the diagram (a) of FIG. 6, the left part of the positive charge source of the first electrode 10 is exposed by shifting the insulator 11 on the first electrode 10 in one direction, for example to the right side.

The second droplet D2 discharged from the discharge tip 21 changes its falling direction to the exposing side of the first electrode 10 (the left side in FIG. 6) due to the attractive force formed between the positive charge of the exposed side of the first electrode 10 and the negative charge of the second droplet D2.

As shown in the diagram (b) of FIG. 6, the right part of the first electrode 10 is exposed by shifting the insulator 11 on the first electrode 10 in one direction, for example to the left side in FIG. 6.

Here, the second droplet D2 discharged from the discharge tip 21 has a negative charge. Accordingly, the falling direction of the second droplet D2 is changed to the exposed side of the first electrode 10 due to the attractive force formed between the second droplet D2 and the exposed part of the first insulator 10.

That is, the attractive force direction to the second droplet D2 is changed according to the exposed part of the first electrode 10. Accordingly, the falling direction of the second droplet D2 can be controlled by controlling the position of the exposed part of the first electrode 10, which is the position of the positive charge source.

It may also be possible to control the position of the falling second droplet D2 simply using the high voltage without using the droplet repulsion phenomenon. However, the speed of the second droplet D2 can be significantly reduced when the position of the second droplet D2 is controlled using the droplet repulsion phenomenon in comparison with the control of the second droplet position only using the high voltage. Accordingly, the position of the second droplet D2 can be effectively controlled.

Hereinafter, various exemplary embodiments of the present invention will be described.

In comparison with the first embodiment of the present invention, the descriptions of similar or the same elements of other embodiments are omitted. The other embodiments of the present invention will be described based only on differences therebetween.

Figure 7:
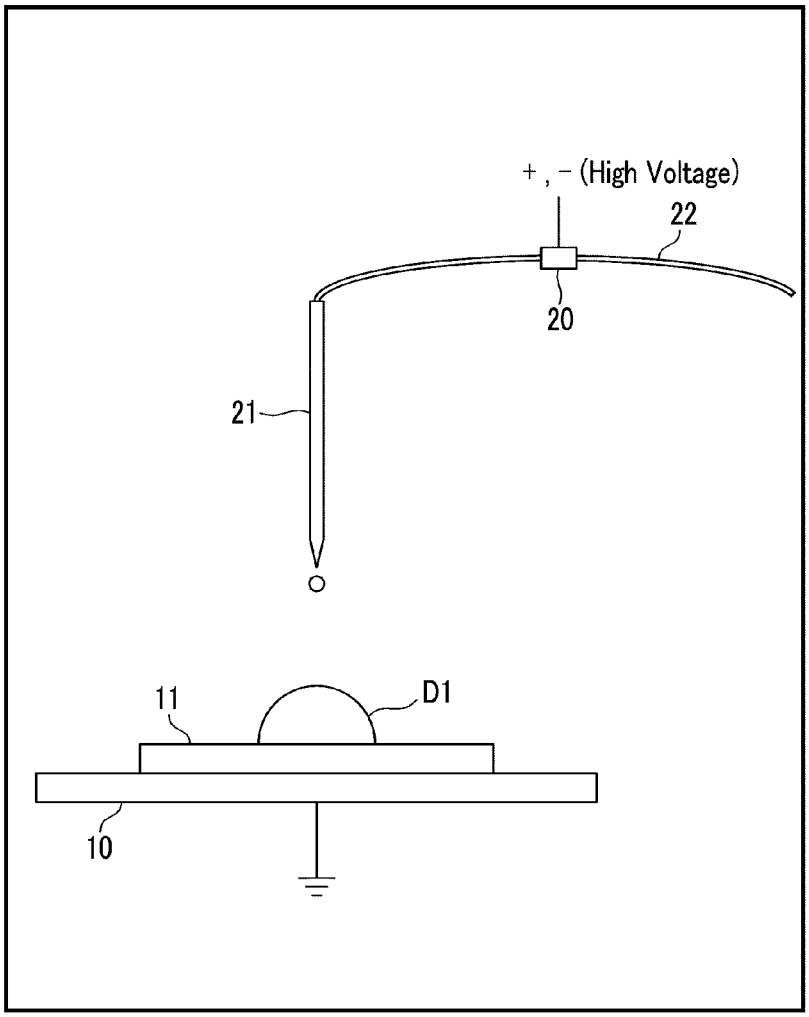
FIG. 7 is a schematic view illustrating an apparatus for controlling droplet motion in an electric field according to the second exemplary embodiment of the present invention.

FIG. 7 is a schematic view of an apparatus for controlling droplet motion in an electric field according to the second exemplary embodiment of the present invention. Referring to FIG. 7, the controlling apparatus according to the second embodiment grounds the first electrode 10 and supplies a positive high voltage or a negative high voltage to the second electrode 20. The second electrode 20 is disposed at a tube 22 connected to the discharge tip 21. The second electrode 20 directly supplies a positive charge or a negative charge to a fluid supplied through the tube 22.

When one of the first electrode 10 and the second electrode 20 is supplied with a high voltage and the other is grounded, the same droplet repulsion occurs as in the first and second exemplary embodiments.

Figure 8:
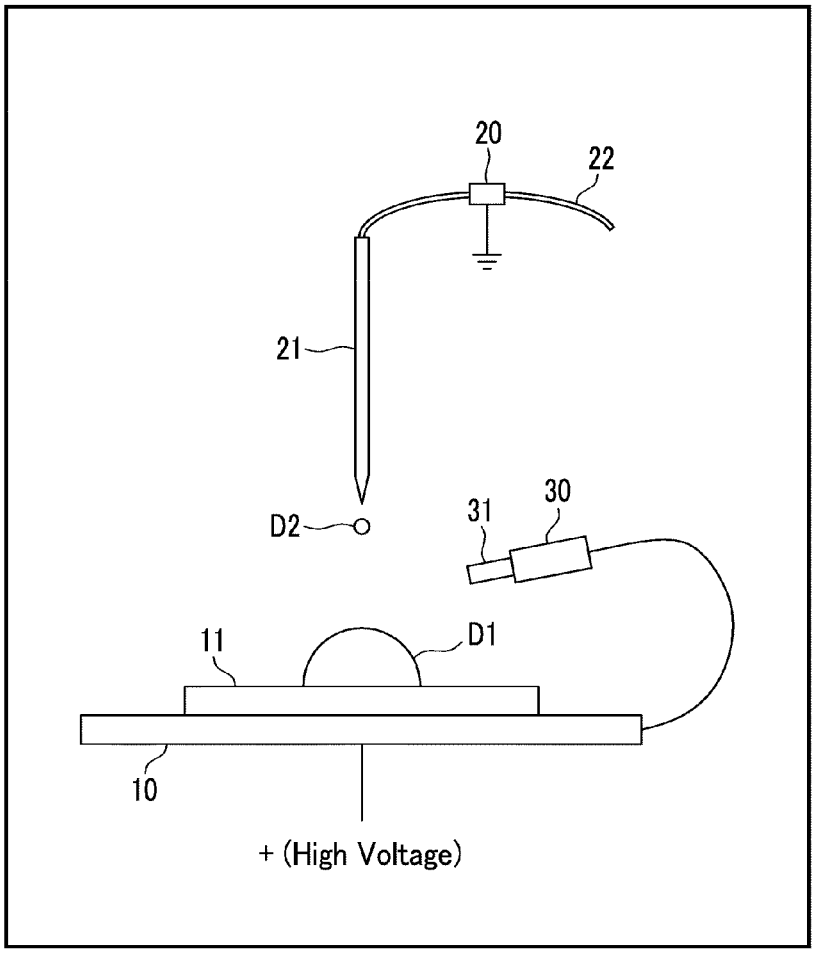
FIG. 8 is a schematic view illustrating an apparatus for controlling droplet motion in an electric field according to the third exemplary embodiment of the present invention.

FIG. 8 is a schematic view of an apparatus for controlling droplet motion according to the third exemplary embodiment of the present invention. Referring to FIG. 8, the controlling apparatus according to the third exemplary embodiment further includes a charge exposing member 30 connected to the first electrode 10 which is a positive charge source. The charge exposing member 30 includes an exposing unit 31 disposed at one end thereof to attract the second droplet D2 having the negative charge, which is repelled by the positive charge source of the exposing unit 31.

Figure 9:
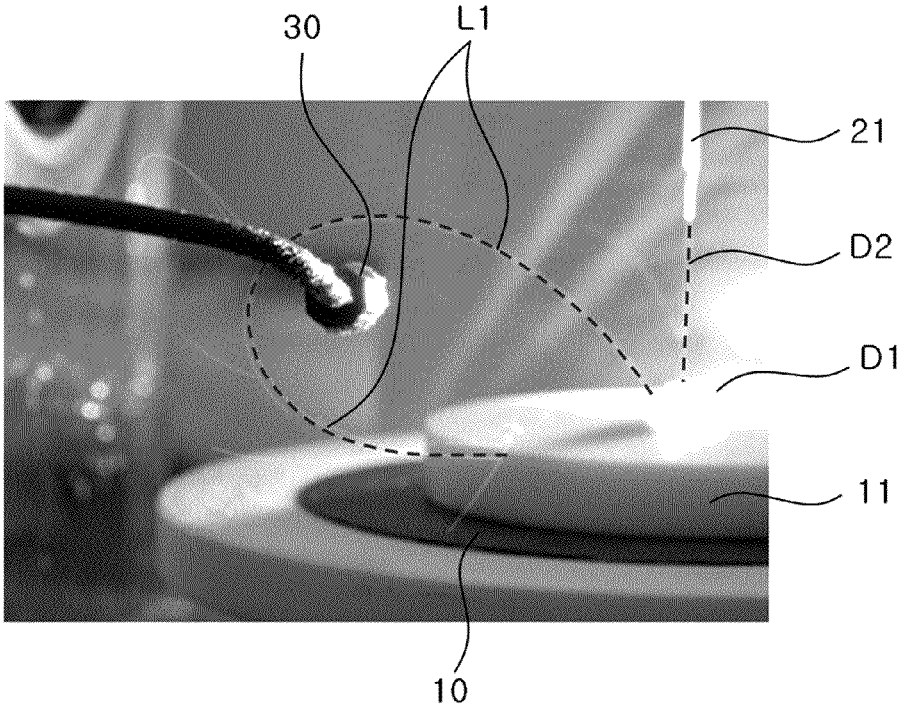
FIG. 9 and FIG. 10 are pictures illustrating directions of second droplet motions according to movement of a charge exposing member in the controlling apparatus of FIG. 8.
Figure 10:
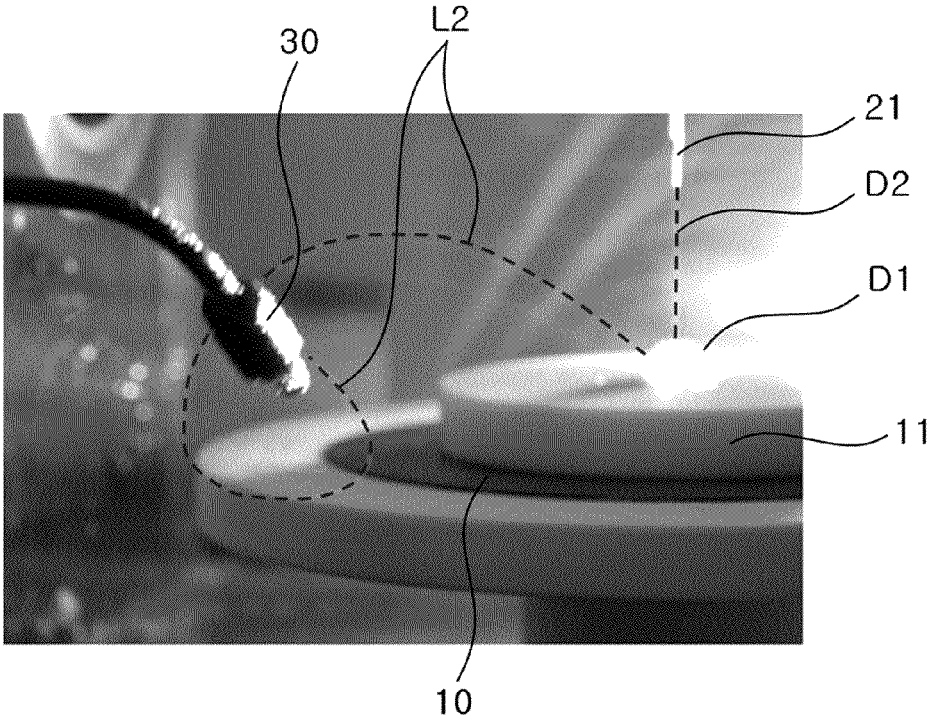

FIG. 9 and FIG. 10 are pictures for comparing directions of second droplet motion changing according to a position of the charge exposing member in the controlling apparatus of FIG. 8. For example, a first electrode 10 is supplied with a high positive voltage.

Referring to FIG. 9 and FIG. 10, the second droplet D2 repelled from the first droplet D1 is tugged toward the exposing member 31 of the charge exposing member 30 by changing the position of the charge exposing member of FIG. 9 to that of FIG. 10.

That is, when the charge exposing member 30 is disposed above the first electrode 10, the falling second droplet D2 moves upwardly to the charge exposing member 30, thereby falling along a falling trace L1. When the charge exposing member 30 is disposed at a side of the first electrode 10, the falling second droplet D2 moves laterally to the charge exposing member 30, thereby falling along a falling trace L2. That is, the motion direction of the second droplet D2 is changed while falling after the second droplet D2 is repelled. Accordingly, the second droplet D2 falls along the spiral falling traces L1 and L2.

In case (not shown) that the charge exposing member 30 is connected to the second electrode 20, it may also be possible to control the position of the second droplet D2.

When the charge exposing member 30 is connected to the first electrode 10, the attractive force is formed between the first electrode 10 and the second droplet D2, and the attractive force influences the second droplet D2 because the first electrode is the positive charge source and the second droplet D2 has the negative charge. However, when the charge exposing member 30 is connected to the second electrode 20, the repulsive force is formed between the second electrode 20 and the second droplet D2 and the repulsive force influences to the second droplet D2 because the second electrode 20 is the negative charge source and the second electrode 20 has the negative charge.

Accordingly, when the tube 22 and the discharge tip 21 having the second electrode 20 shift or when the charge exposing member 30 is connected to the second electrode 20, the opposite experimental result may be obtained in comparison with the experiment performed by connecting the first electrode 10 with the charge exposing member 30.

Hereinafter, a method of controlling droplet motion of a second droplet D2 by changing other conditions rather than changing the position of the positive charge source will be described.

Figure 11:
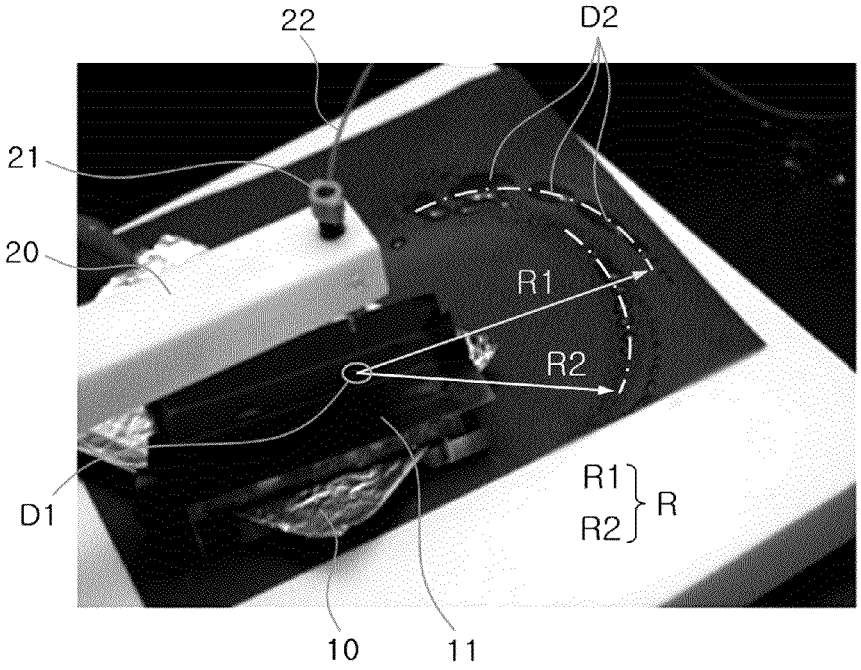
FIG. 11 is a picture illustrating second droplets repelled at a predetermined distance in the controlling apparatus according to the first exemplary embodiment of the present invention.

FIG. 11 is a picture illustrating second droplets repelled at a predetermined constant distance in the controlling apparatus according to the first exemplary embodiment of the present invention. As an example, a high positive voltage is supplied to the first electrode 10.

The position of the second droplet D2 may be controlled by controlling the volume, position, and direction of the first droplet D1. When a second droplet D2 falling in a vertical direction from the discharge tip 21 approaches the first droplet D2 formed under the second droplet D2, a repulsion angle and a repulsion speed of the second droplet D2 are different according to the volume, position, and direction of the first droplet D1 as shown.

When a plurality of second droplets D2 repelled from the first droplets D1 are continuously observed, the plurality of second droplets D2 are repelled in the same direction along the same falling trace. However, the second droplets D2 have a tendency of avoiding the previously dropped second droplets D2 because the plurality of second droplets D2 have the same polarity. FIG. 11 clearly shows such tendency. That is, FIG. 11 shows that the plurality of second droplets D2 are sequentially repelled and dropped with a predetermined radius (R) from the first droplet D1 as a center.

The position of the second droplet D2 may be controlled according to a voltage supplied to the first electrode in addition to the volume and shape of the first droplet D1. When the same voltage is supplied, the second droplet D2 drops with the same radius (R) based on the first droplet D1 as a center as shown in FIG. 11. However, such repulsion distances R1 and R2 may be changed according to the voltage supplied thereto.

For example, the stronger the voltage that is supplied, the shorter the repulsion distance becomes. That is, the second droplet D2 repelled around the first droplet D1 is bounced upwardly. At this moment, the stronger the voltage that is supplied to the first electrode 10, the greater the attractive force to the first electrode 10 becomes. That is, the attractive force in a downward direction becomes greater. Accordingly, the second droplet D2 becomes less-bounced and a force in a horizontal direction for breaking away from the first electrode 10 is disturbed in comparison with a low voltage applied.

Figure 12:
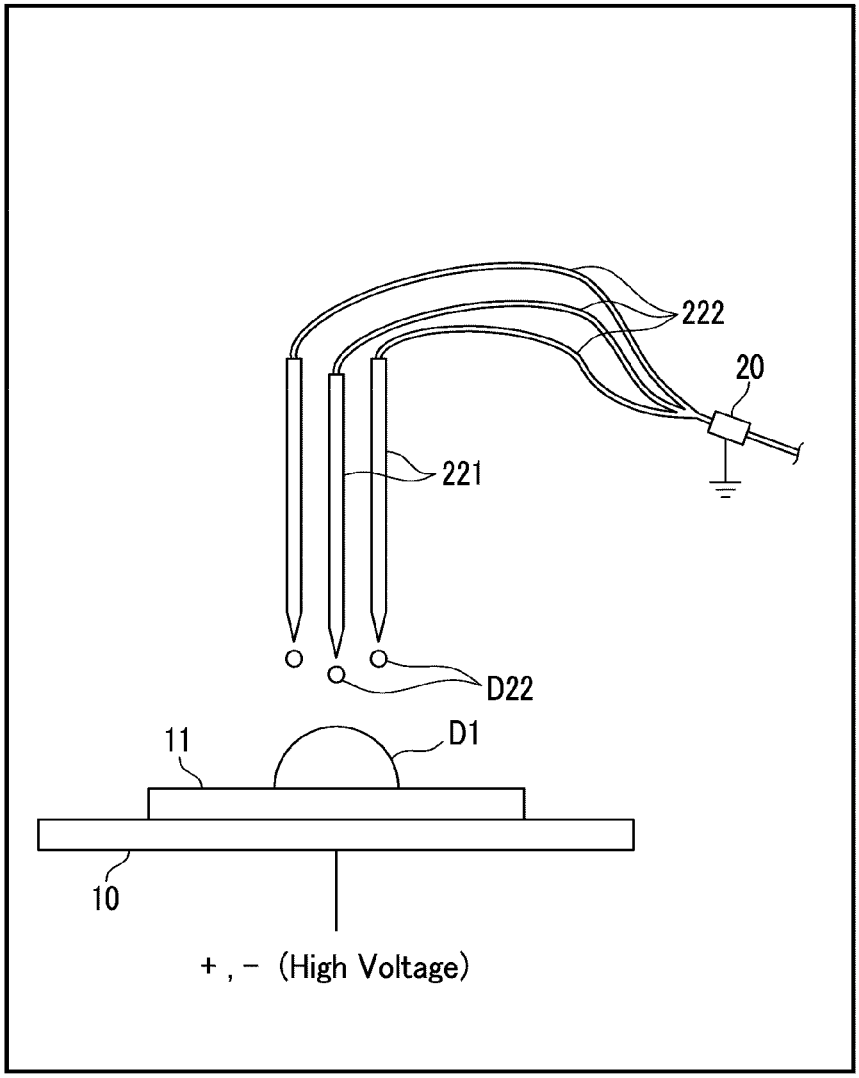
FIG. 12 is a schematic view illustrating an apparatus for controlling droplet motion in an electric field according to the fourth exemplary embodiment of the present invention.

FIG. 12 is a schematic view illustrating an apparatus for controlling droplet motion according to the fourth exemplary embodiment of the present invention. Referring to FIG. 11, the controlling apparatus according to the fourth exemplary embodiment includes a plurality of discharge tips 221, unlike the controlling apparatus according to the first exemplary embodiment.

Each one of the plurality of discharge tips 221 forms a strong electric field at an end thereof by a potential difference identically formed between the discharge tips 221 and the first electrode 10, and discharges the second droplets D22. The plurality of discharge tips 221 are respectively connected to a plurality of tubes 222 divided from an integral tube part, and simultaneously discharge droplets of the same type of fluid. Here, the second electrode 20 is connected to the integral tube part of the tubes 222 and supplies a high voltage to or grounds the fluid supplied by the tube 222.

The amount of discharging droplets of each of the plurality of discharge tips 221 may be controlled by controlling the interior diameter or the discharge opening to be different in case of simultaneously discharging the same type of fluid droplets.

Figure 13:
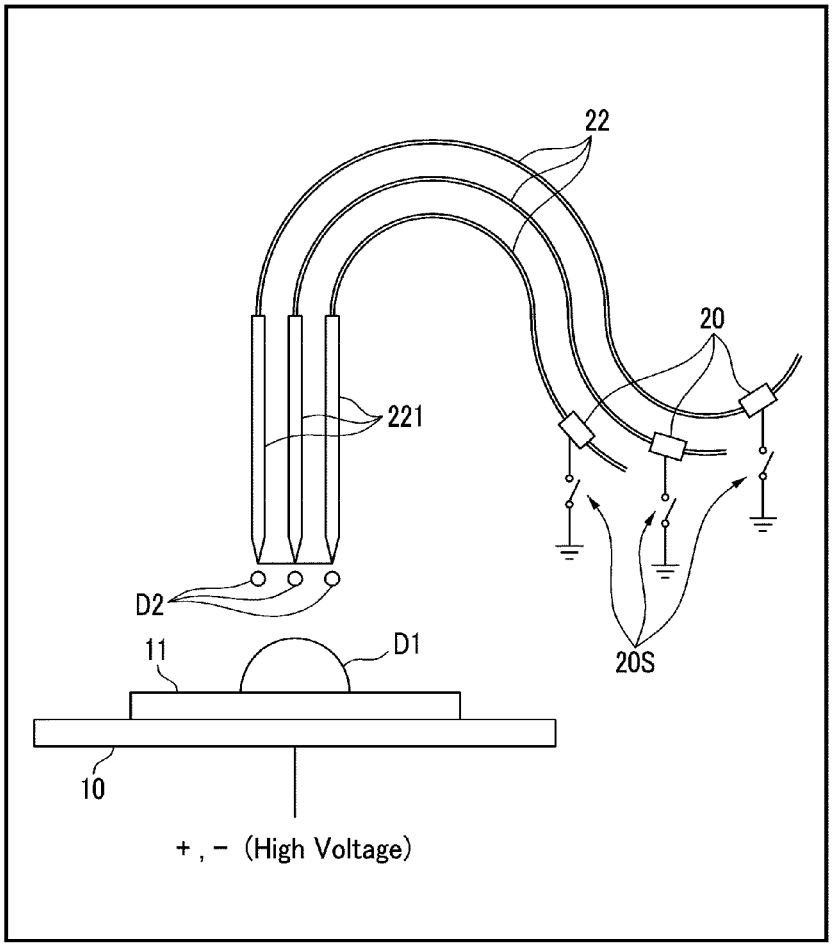
FIG. 13 is a schematic view illustrating an apparatus for controlling droplet motion in an electric field according to the fifth exemplary embodiment of the present invention.

FIG. 13 is a schematic view of an apparatus for controlling droplet motion according to the fifth exemplary embodiment of the present invention. Referring to FIG. 12, the controlling apparatus according to the fifth exemplary embodiment includes a plurality of tubes 222 respectively connected to a plurality of discharge tips 221, unlike the controlling apparatus according to the fourth exemplary embodiment. The plurality of divided tubes 222 and discharge tips 221 may simultaneously discharge the same type of fluid droplets or different types of fluid droplets.

The second electrodes 20 are independent installed at each one of the divided tubes 222 and independently controlled by switches 20S connected to the second electrodes. Accordingly, the second electrodes 20 are independently controlled by the switches 20S and supply different high voltages to or ground the fluid supplied to the tubes 222 and discharge tips 221.

Figure 14:
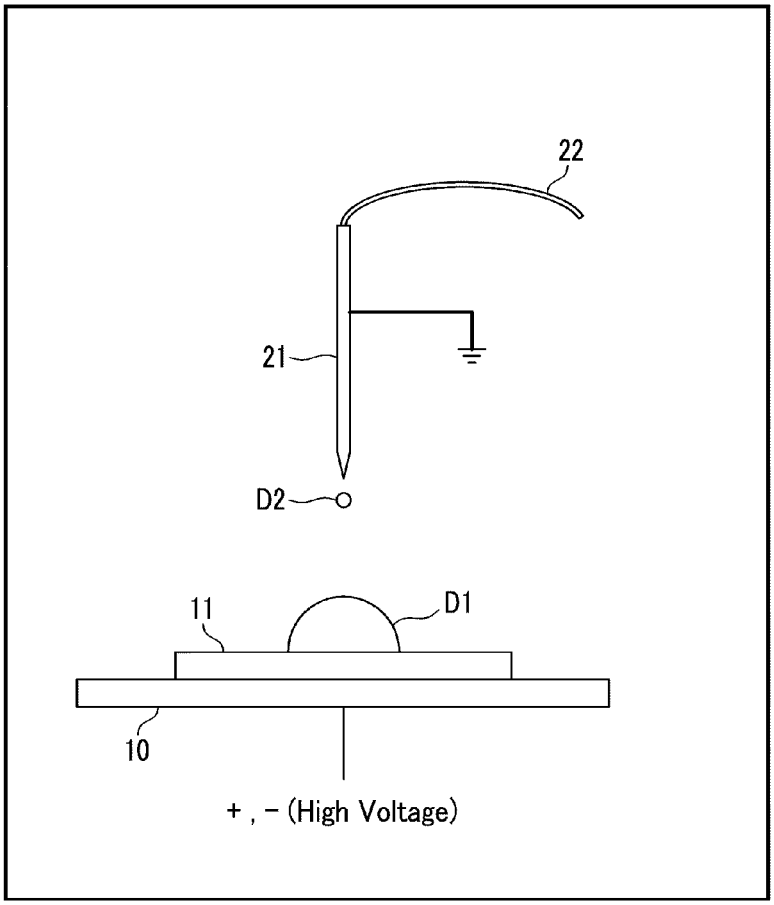
FIG. 14 is a schematic view illustrating an apparatus for controlling droplet motion in an electric field according to the sixth exemplary embodiment of the present invention.

FIG. 14 is a schematic view illustrating an apparatus for controlling motion of a droplet in an electric field according to the sixth exemplary embodiment of the present invention. Referring to FIG. 14, the controlling apparatus according to the sixth exemplary embodiment supplies a high voltage to the first electrode 10 and directly grounds the discharge tip 21, unlike the controlling apparatus according to the first exemplary embodiment. That is, as well as discharging the droplets, the discharge tip 21 simultaneously plays the role of a grounded second electrode 20. Accordingly, the controlling apparatus according to the sixth exemplary embodiment excludes the second electrode 20 of the controlling apparatus according to the first exemplary embodiment.

The discharge tip 21 according to the sixth exemplary embodiment may be made of a conductor such as a metal in order to be grounded. Like the fourth and fifth exemplary embodiments, a plurality of discharge tips 21 (not shown) may be disposed above the first electrode 10 and be grounded.

Figure 15:
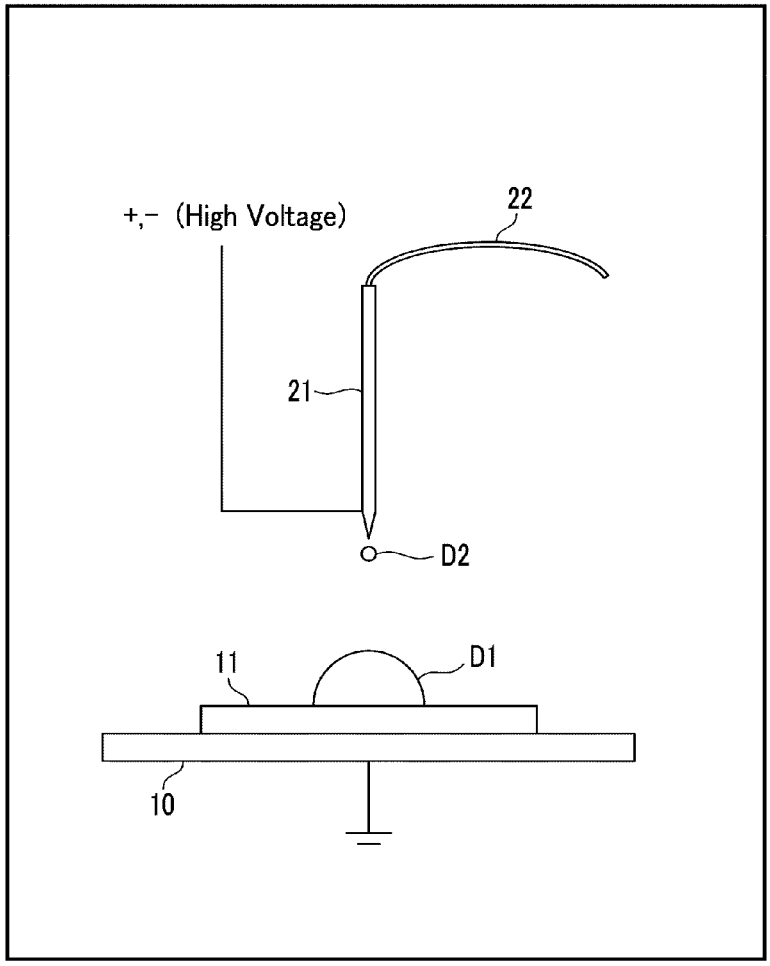
FIG. 15 is a schematic view illustrating an apparatus for controlling droplet motion in an electric field according to the seventh exemplary embodiment of the present invention.

FIG. 15 is a schematic view illustrating an apparatus for controlling droplet motion in an electric field according to the seventh exemplary embodiment of the present invention. Referring to FIG. 15, the controlling apparatus according to the seventh exemplary embodiment grounds the first electrode 10 and directly supplies a high voltage to the first electrode 10, unlike the controlling apparatus according to the second exemplary embodiment. That is, as well as discharging droplets, the discharge tip 21 simultaneously plays the role of the second electrode supplying a high voltage. Accordingly, the controlling apparatus according to the seventh exemplary embodiment excludes the second electrode, unlike the controlling apparatus according to the second exemplary embodiment.

The discharge tip 21 according to the seventh exemplary embodiment may be made of a conductor such as a metal in order to supply a high voltage. In this case, the discharge tip 21 may be supplied with a high positive charge voltage or a high negative charge voltage like the second electrode 20 of the controlling apparatus according to the second exemplary embodiment. Like the controlling apparatus according to the fourth and fifth exemplary embodiments, a plurality of discharge tips 21 (not shown) may be disposed above the first electrode 10 and be supplied with a high voltage.

Figure 16:
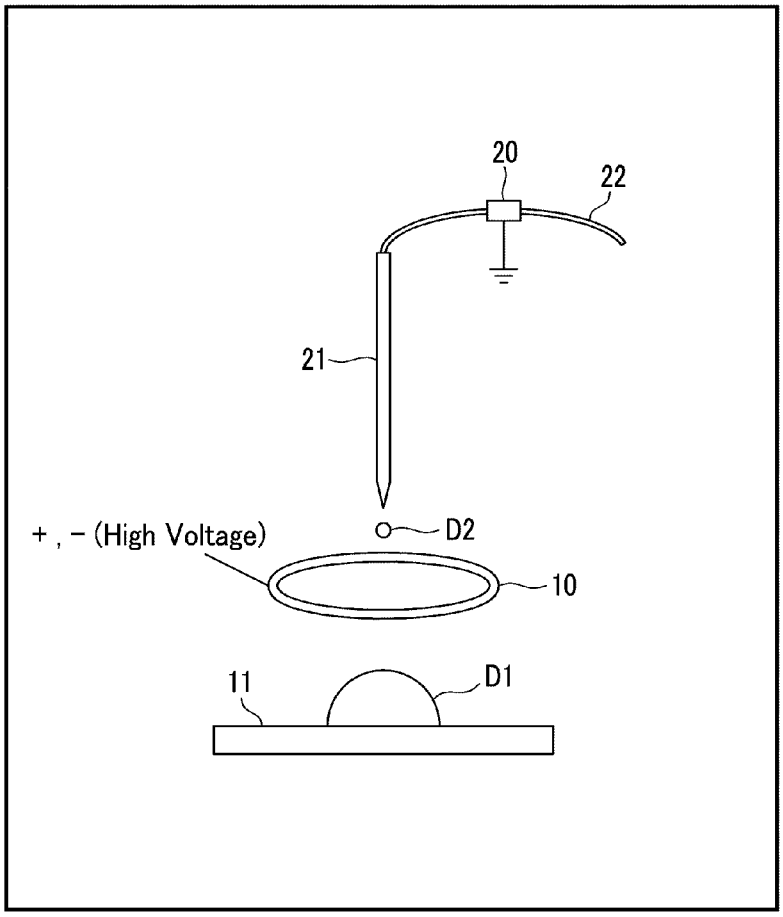
FIG. 16 is a schematic view illustrating an apparatus for controlling droplet motion in an electric field according to the eighth exemplary embodiment of the present invention.

FIG. 16 is a schematic view illustrating an apparatus for controlling droplet motion in an electric field according to the eighth exemplary embodiment of the present invention. Referring to FIG. 16, unlike the controlling apparatus of the first exemplary embodiment, the controlling apparatus according to the eighth exemplary embodiment includes a ring-type first electrode 10 disposed between an insulator 11 and a discharge tip 21, and a second electrode 20 contacting the fluid supplied to the discharge tip 21. The first electrode 10 passes the second droplet D2 discharged from the discharge tip 21.

When the first electrode 10 is supplied with a high voltage and the second electrode 20 is grounded, a large potential difference is formed between the first electrode 10 and the discharge tip 21, and a strong electric field is formed at the end of the discharge tip 21.

Figure 17:
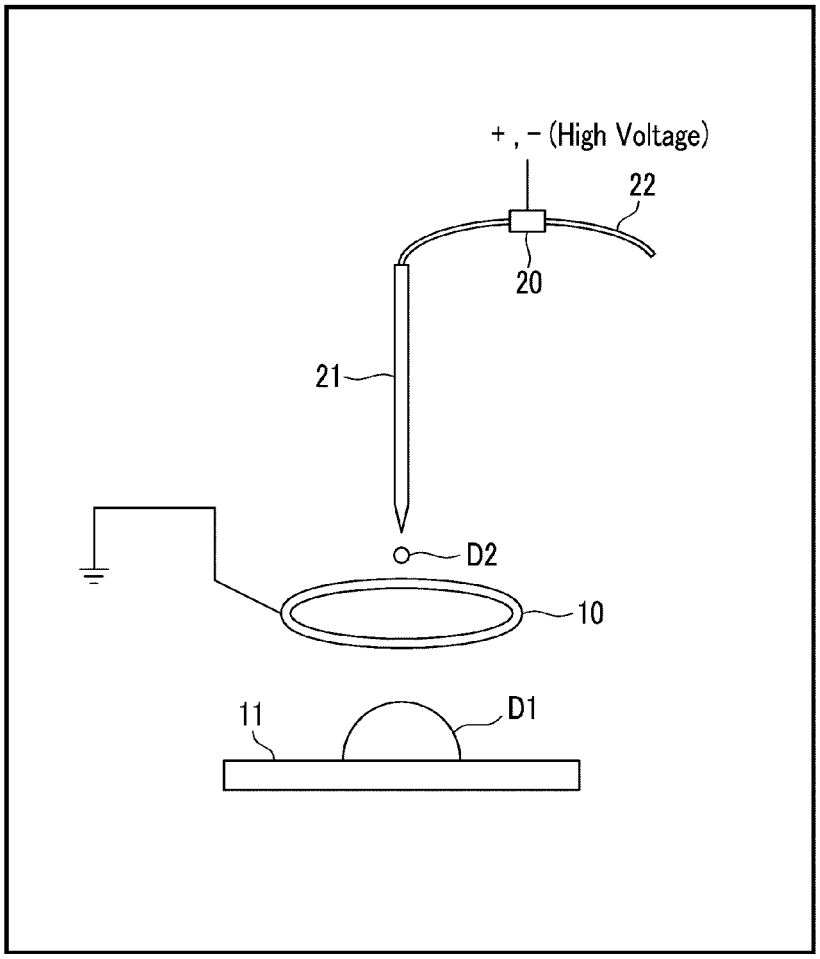
FIG. 17 is a schematic view illustrating an apparatus for controlling droplet motion in an electric field according to the ninth exemplary embodiment of the present invention.

FIG. 17 is a schematic view illustrating an apparatus for controlling droplet motion in an electric field according to the ninth exemplary embodiment of the present invention. Referring to FIG. 17, the controlling apparatus according to the ninth exemplary embodiment includes a ring-type first electrode 10 disposed between an insulator 11 and a discharge tip 21 and a second electrode 20 contacting the fluid supplied to the discharge tip 21, unlike the controlling apparatus according to the second exemplary embodiment. The first electrode 10 passes the second droplet D2 discharged from the discharge tip 21.

When the first electrode 10 is grounded and the second electrode 20 is supplied with a high voltage, a large potential difference is formed between the first electrode 10 and the discharge tip 21, and a strong electric field is formed at the end of the discharge tip 21.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for controlling droplet motion in an electric field, comprising:

a first electrode;

an insulator disposed above the first electrode and shiftable on the first electrode;

a discharge tip disposed above the insulator by a predetermined distance and dividing a transferred fluid into a small volume of a second droplet; and a second electrode contacting the fluid supplied through the discharge tip, wherein the first electrode and the second electrode form an electric field at an end of the discharge tip by forming a potential difference between the first electrode and the second electrode, wherein the first electrode is supplied with a high voltage or is grounded, and the second electrode is grounded or supplied with a high voltage on the contrary to the first electrode, wherein a first droplet is formed on the insulator and charged with electricity opposite to the first electrode, and the first droplet is configured to repel the second droplet away from the first droplet as the second droplet approaches the first droplet, wherein a falling direction of the second droplet is controlled by shifting the insulator on the first electrode, and wherein one side of the first electrode is exposed by shifting the insulator on the first electrode such that the falling direction of the second droplet discharged from the discharge tip is changed to be directed toward the exposed one side of the first electrode due to attractive force formed between the exposed one side of the first electrode and the second droplet.

2. The apparatus of claim 1, wherein the first electrode and the second electrode are supplied with a positive or negative charge when a high voltage is supplied to the first and second electrodes.

3. The apparatus of claim 1, wherein the first electrode is supplied with a high voltage, and the second electrode is disposed at a tube connected to the discharge tip and grounds the fluid.

* * * * *